US011033101B2

(12) United States Patent
Bonato et al.

(10) Patent No.: US 11,033,101 B2
(45) Date of Patent: Jun. 15, 2021

(54) TABLE WITH TILTING SURFACE

(71) Applicant: METALMECCANICA ALBA SRL, San Zenone Degli Ezzelini (IT)

(72) Inventors: Nicola Bonato, Borso del Grappa (IT); Marco Bragagnolo, Castelfranco Veneto (IT); Francesco Sabini, Loria (IT); Fabrice Frison, Borso del Grappa (IT); Maurizio Dallan, Asolo (IT)

(73) Assignee: METALMECCANICA ALBA SRL, San Zenone Degli Ezzelini (IT)

( * ) Notice: Subject to any disclaimer, the term of this patent is extended or adjusted under 35 U.S.C. 154(b) by 0 days.

(21) Appl. No.: 15/931,710

(22) Filed: May 14, 2020

(65) Prior Publication Data

US 2020/0367639 A1 Nov. 26, 2020

(30) Foreign Application Priority Data

May 20, 2019 (IT) ..... 102019000006990

(51) Int. Cl.
*A47B 3/08* (2006.01)

(52) U.S. Cl.
CPC ..... *A47B 3/0803* (2013.01); *A47B 3/0809* (2013.01); *A47B 2200/0036* (2013.01)

(58) Field of Classification Search
CPC ..... A47B 3/00; A47B 3/0803; A47B 3/02; A47B 3/0809; A47B 2200/0036; A47B 2200/0037; A47B 2200/0043
USPC ..... 108/115
See application file for complete search history.

(56) References Cited

U.S. PATENT DOCUMENTS 5,205,223 A * 4/1993 Ball ..... A47B 3/0803 108/115
6,336,414 B1 * 1/2002 Stewart ..... A47B 3/0815 108/115
7,066,098 B2 * 6/2006 Blasen ..... A47B 3/08 108/115
7,677,184 B2 * 3/2010 Dhanoa ..... A47B 3/0812 108/115
7,765,938 B2 * 8/2010 Piretti ..... A47B 7/02 108/115
7,878,128 B2 * 2/2011 Watson ..... A47B 3/0803 108/132
8,091,488 B2 * 1/2012 Chirea ..... A47B 3/08 108/115
8,291,830 B2 * 10/2012 Rutz ..... A47B 3/0818 108/7
8,297,207 B2 * 10/2012 Liu ..... A47B 13/021 108/115

(Continued)

FOREIGN PATENT DOCUMENTS

CA 3021402 A1 * 4/2019 ..... A47B 13/081
CN 202375399 U 8/2012

(Continued)

OTHER PUBLICATIONS

Italian Search Report dated Nov. 11, 2019 issued in IT 201900006990, with partial translation.

*Primary Examiner* — Jose V Chen
(74) *Attorney, Agent, or Firm* — Scully, Scott, Murphy & Presser, P.C.

(57) ABSTRACT

A table with a tilting tabletop and ground support legs, having elements adapted to cause, upon a tilting of the tabletop, also a rotation of the ground support legs with respect to the ground.

9 Claims, 11 Drawing Sheets

(56) References Cited

U.S. PATENT DOCUMENTS

| | | | | |
|---|---|---|---|---|
| 8,359,983 | B2 * | 1/2013 | Williamson | A47B 91/02 108/115 |
| 8,539,888 | B2 * | 9/2013 | Hernandez | A47B 85/06 108/115 |
| 9,138,051 | B2 * | 9/2015 | Pan | A47B 7/02 |
| 9,265,340 | B2 * | 2/2016 | Krusin | A47C 4/04 |
| 9,609,945 | B2 * | 4/2017 | Krusin | A47C 7/00 |
| 9,642,451 | B2 * | 5/2017 | Okuda | A47B 3/08 |
| 9,950,728 | B2 * | 4/2018 | Weiser | A47B 13/021 |
| 2004/0083932 | A1 * | 5/2004 | Kottman | A47B 3/00 108/115 |
| 2006/0230991 | A1 * | 10/2006 | Piretti | A47B 3/0803 108/115 |
| 2007/0209559 | A1 * | 9/2007 | Mockel | A47B 3/0803 108/115 |
| 2007/0261611 | A1 * | 11/2007 | Kumazawa | A47B 3/0815 108/115 |
| 2007/0261613 | A1 | 11/2007 | Watson et al. | |
| 2008/0017082 | A1 * | 1/2008 | Bue | A47B 3/00 108/115 |
| 2008/0178778 | A1 * | 7/2008 | Koning | A47B 3/0818 108/132 |
| 2009/0283020 | A1 * | 11/2009 | Hsu | A47B 3/0815 108/115 |
| 2011/0017107 | A1 * | 1/2011 | Ko | A47B 3/0818 108/64 |
| 2011/0139042 | A1 * | 6/2011 | Korb | A47B 3/00 108/115 |

FOREIGN PATENT DOCUMENTS

| | | | | |
|---|---|---|---|---|
| DE | 202014101396 | U1 * | 4/2014 | A47B 3/0815 |
| EP | 1308109 | A1 * | 5/2003 | A47B 7/02 |
| IT | B020090736 | A1 | 5/2011 | |
| WO | WO-0113762 | A1 * | 3/2001 | A47B 3/08 |
| WO | WO-2020035809 | A1 * | 2/2020 | A47B 95/00 |

* cited by examiner

TABLE WITH TILTING SURFACE

The present invention relates to a table provided with a tilting tabletop and with ground support legs.

Nowadays tables are known which comprise a tabletop which is supported by adapted legs for resting on the ground.

Some of these tables have, underneath the tabletop, special mechanisms which are adapted to allow the rotation of the tabletop until it is arranged for example on a plane that is substantially vertical with respect to the ground.

This makes it possible to save space when the table for example is not used and is therefore for example stored against a wall after having tilted the tabletop.

This solution has drawbacks, which include the fact that, since the legs of the table are fixed, storing several identical tables side by side, even with the tabletops tilted, presents an encumbrance that is dictated by the dimensions and arrangement of the legs.

The aim of the present application is to solve the above mentioned technical problems, eliminating the drawbacks in the cited known art, by providing a table that has a tilting tabletop and which at the same time can be stored alongside other, identical tables with the tabletop tilted, while reducing the space that they take up overall.

Within this aim, an object of the invention is to provide a table that, in addition to the foregoing characteristics, also enables the operator to vary the arrangement of the tabletop while always remaining outside the radius of action, thus reducing the risk of being subjected to impact or collision.

Another object is to provide a table with a titling tabletop wherein the position of the tabletop is stable both in the active position and in the inactive position.

Another object is to provide a table with a tilting tabletop wherein the foregoing characteristics can be achieved rapidly and safely, while remaining free from possible signs of wear and tear and the beginnings of shearing.

Another object is to obtain a table that, in addition to the foregoing characteristics, is also structurally simple, is of low cost, and can be made with the usual conventional plants.

This aim and these and other objects which will become better apparent hereinafter are achieved by a table with a tilting tabletop and ground support legs, characterized in that it has means adapted to cause, upon the tilting of said tabletop also the rotation of said legs with respect to the ground.

Further characteristics and advantages of the invention will become better apparent from the detailed description of a particular but not exclusive embodiment thereof, illustrated by way of non-limiting example in the accompanying drawings, wherein.

Figure 1:
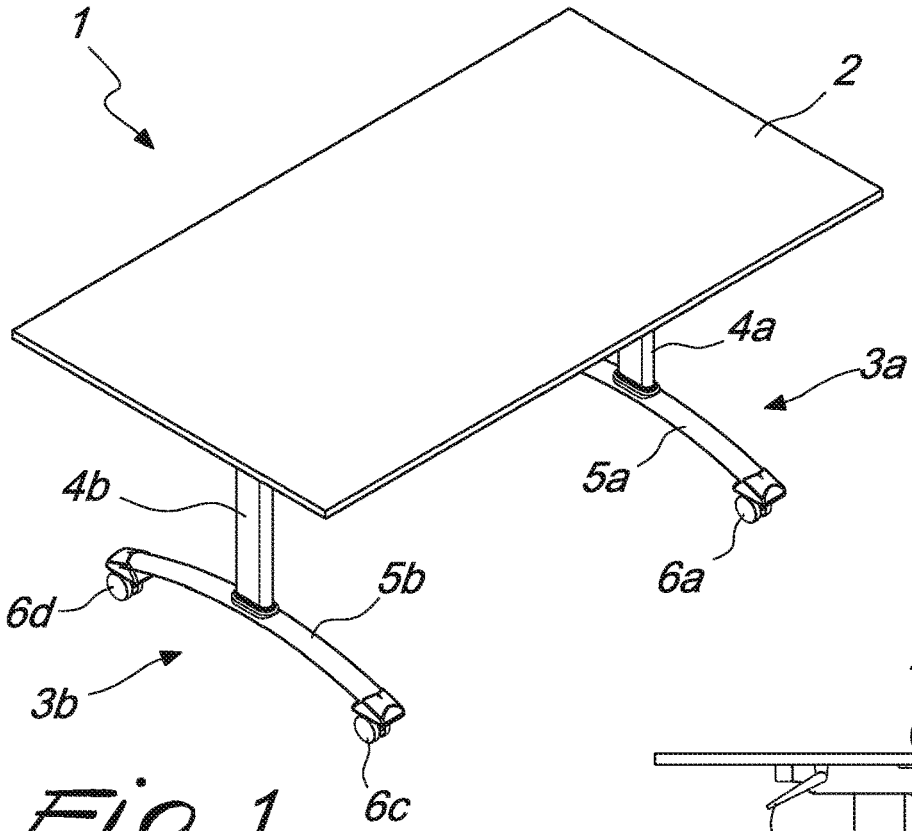
FIG. 1 is a perspective view of the table according to the invention in the open condition.
Figure 2:
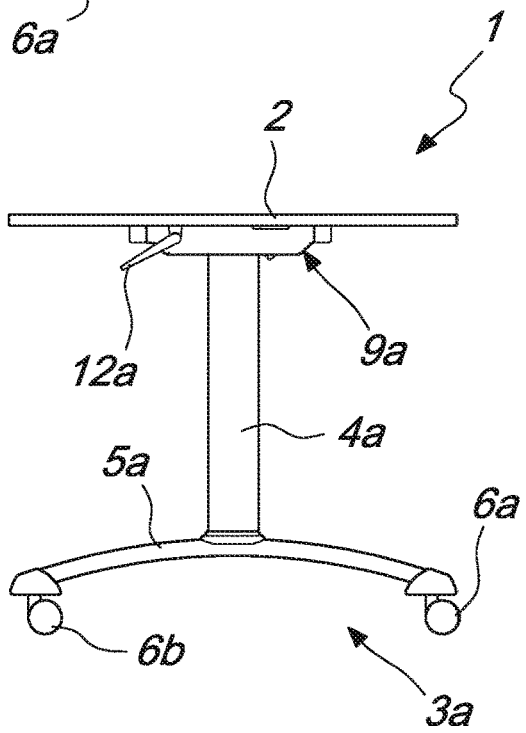
FIG. 2 is a side view of the table.
Figure 3:
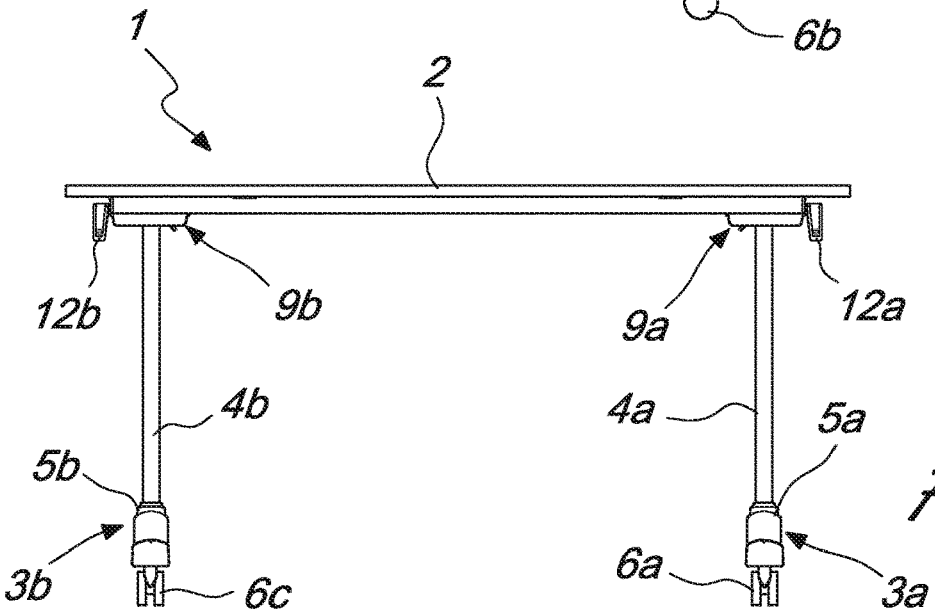
FIG. 3 is a front elevation view of the table.
Figure 4:
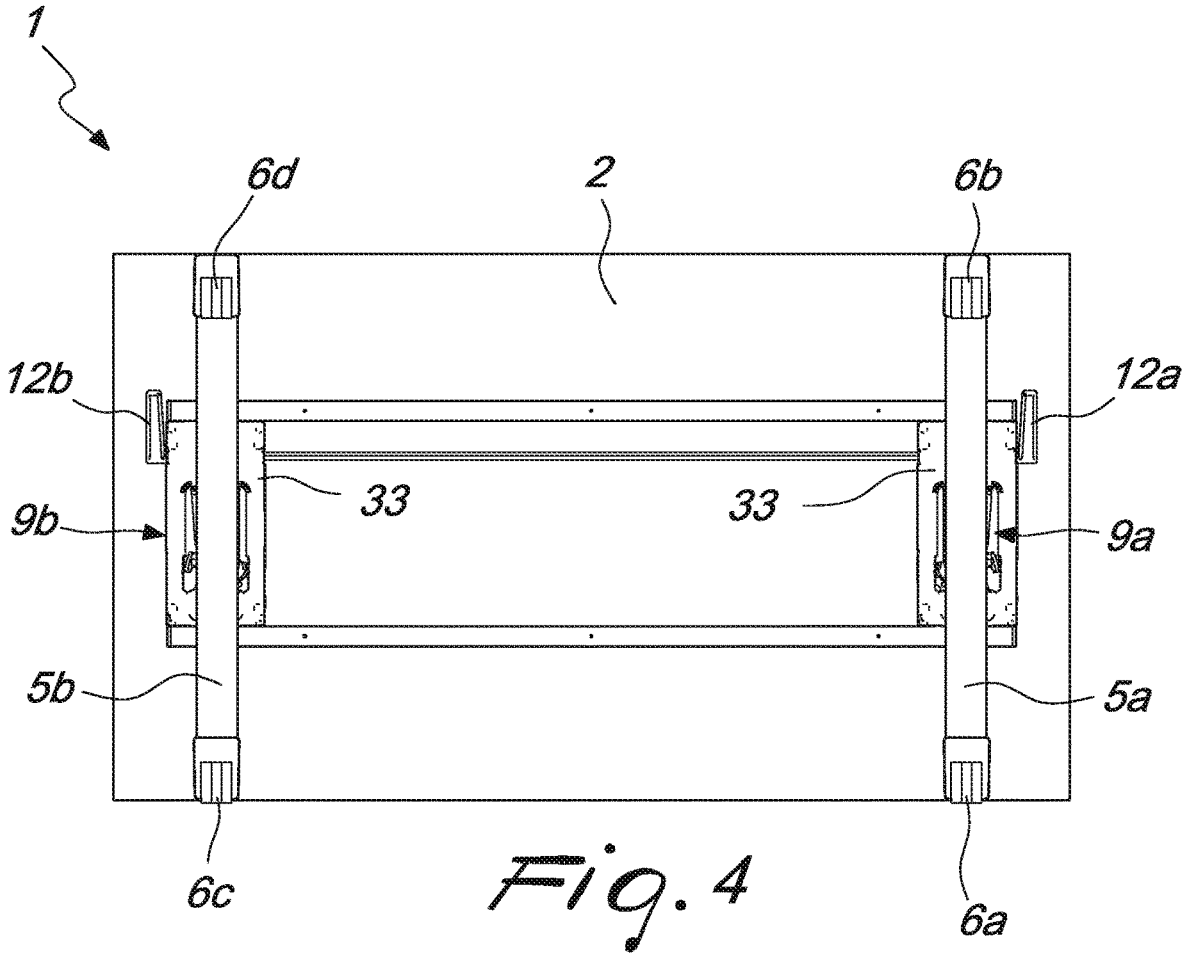
FIG. 4 is a view from below of the table.
Figure 5:
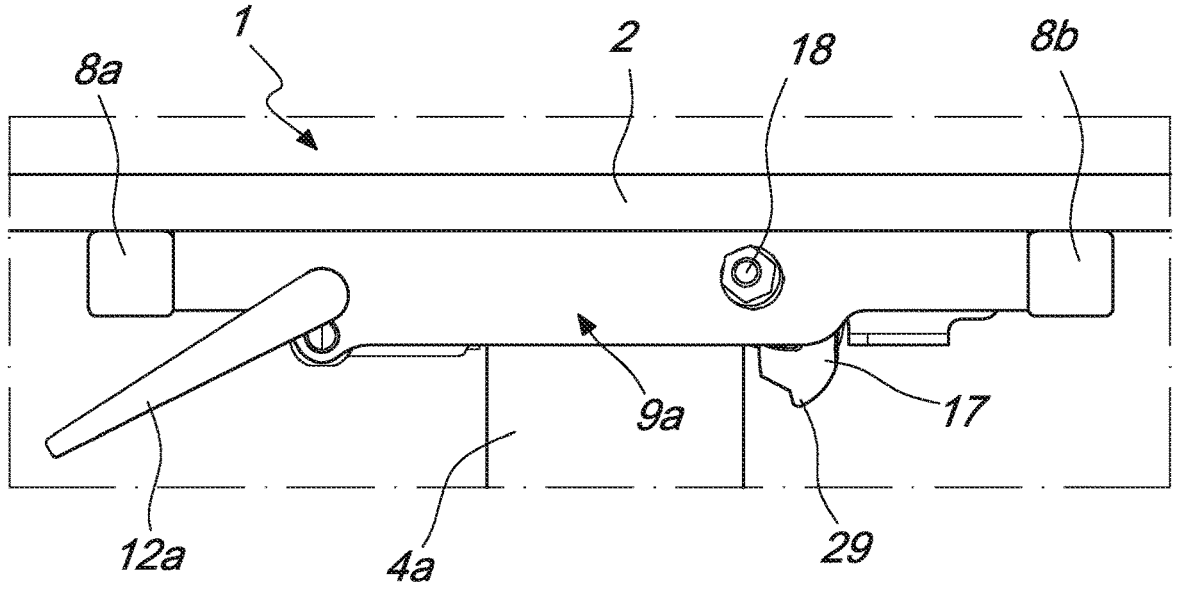
FIG. 5 is a side view showing a detail of the table and without the housing.

In the exemplary embodiments that follow, individual characteristics, given in relation to specific examples, may actually be interchanged with other different characteristics of other exemplary embodiments.

With reference to the figures, the reference numeral 1 generally indicates a table provided with a tilting tabletop 2, advantageously rectangular in plan view, and with ground support legs.

In the particular embodiment shown, two pairs of legs 3*a*, 3*b* are indicated, each one composed of a vertical post 4*a*, 4*b* which is connected at a lower end to a longitudinal member 5*a*, 5*b*, the width of which is about equal or otherwise to that of the tabletop 2, with pairs of wheels 6*a*, 6*b*, 6*c*, 6*d* associated in a lower region with the ends.

A tubular frame 7 is associated below the tabletop 2 and is composed of two crossmembers 8*a*, 8*b*, which are shorter than the tabletop 2 and are connected at the ends by two mutually mirror-symmetrical first box-like plates 9*a*, 9*b*, which have a C-shaped cross-section the base 10*a*, 10*b* of which is rectangular and is rendered integral in a lower region with the tabletop 2 and the first wings 11*a*, 11*b* of which are directed toward the ground.

Associated below the tabletop 2 are means adapted to cause, upon the tilting of the tabletop 2 to the vertical, also the rotation of the legs 3*a*, 3*b* with respect to their ground support plane.

Such means comprise two mutually identical handles 12*a*, 12*b*, which are associated rotatably proximate to an end of the first wings 11*a*, 11*b* and are keyed to a shaft 13 which is adapted to transmit the rotary motion imparted to the handles by the user.

Between each of the first wings 11*a*, 11*b* there is furthermore, in axial alignment with the shaft 13, a block 14*a*, 14*b* which rotates integrally with the shaft 13 and which has a first tooth 15*a*, 15*b* which protrudes axially therefrom approximately parallel to the bases 10*a*, 10*b* and in the opposite direction with respect to the handles 12*a*, 12*b*.

A second plate 16*a*, 16*b* is associated at each one of the bases 10*a*, 10*b*, is also C-shaped, is shorter than the first box-like plates 9*a*, 9*b*, and extends approximately from a region underneath the first teeth 15*a*, 15*b* in the opposite direction with respect to the handles 12*a*, 12*b*.

Each second plate 16*a*, 16*b* has a pair of second wings 17 which protrude at the opposite end with respect to the handles 12*a*, 12*b* and between which a rotation pivot 18*a*, 18*b* is arranged.

The free ends of the vertical posts 4*a*, 4*b* are rendered integral with the second plates 16*a*, 16*b*.

Figure 11:
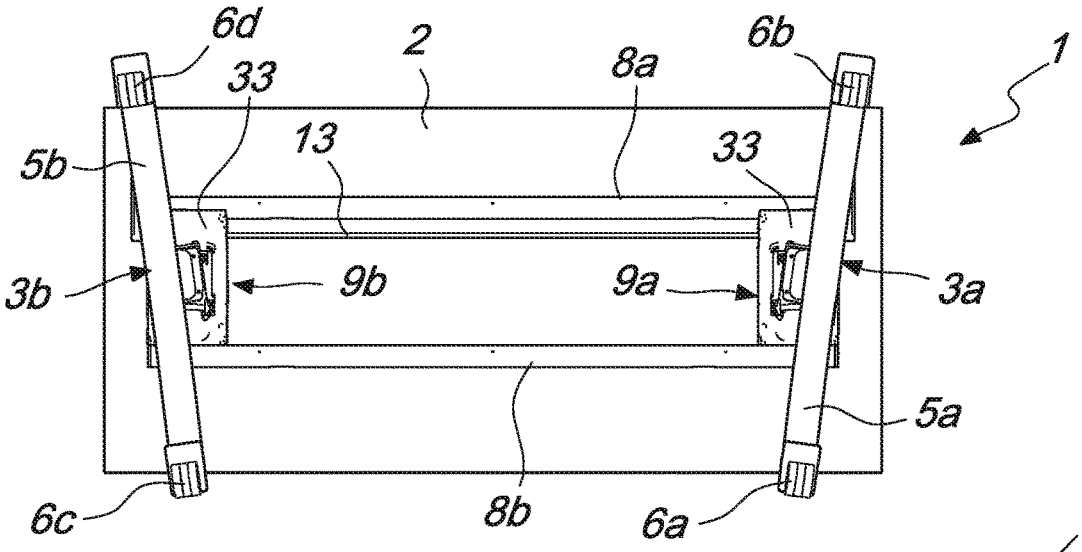
FIG. 11 is a view from below of the table in the condition of FIG. 9.
Figure 12:
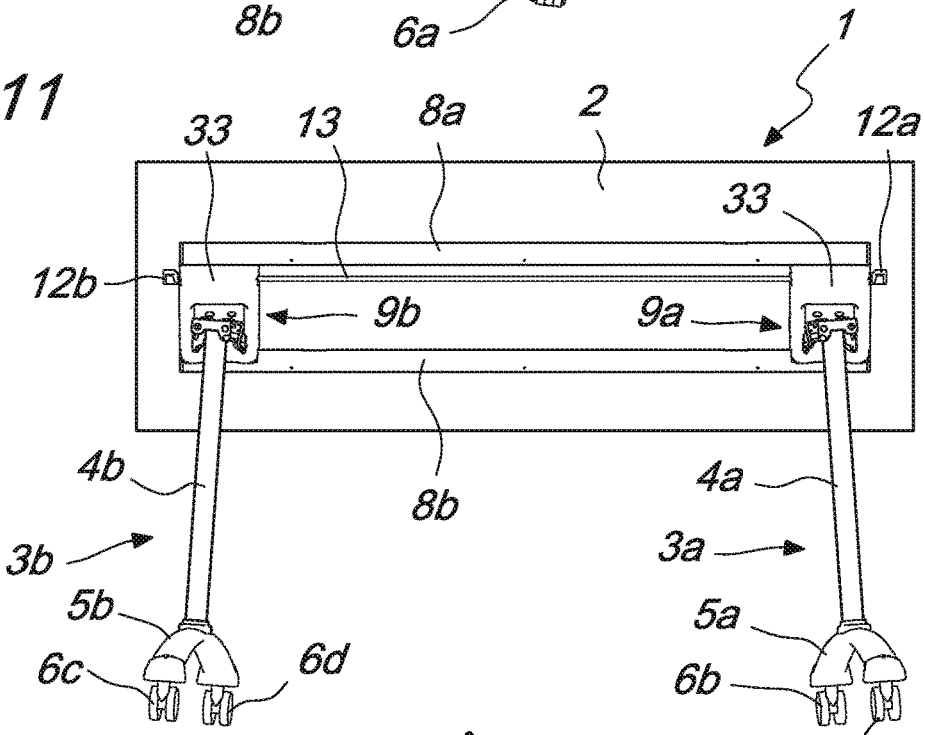
FIG. 12 is a front elevation view of the table in the condition of FIG. 9.
Figure 13:
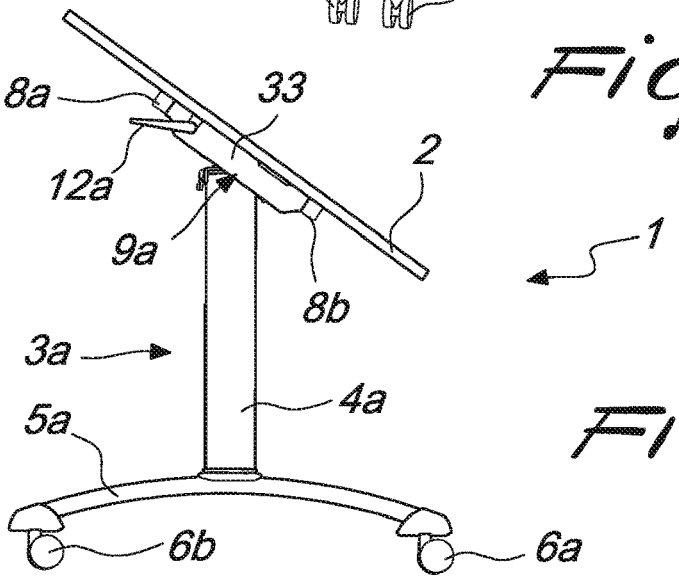
FIG. 13 is a side view of the table in the condition of FIG. 9.
Figure 14:
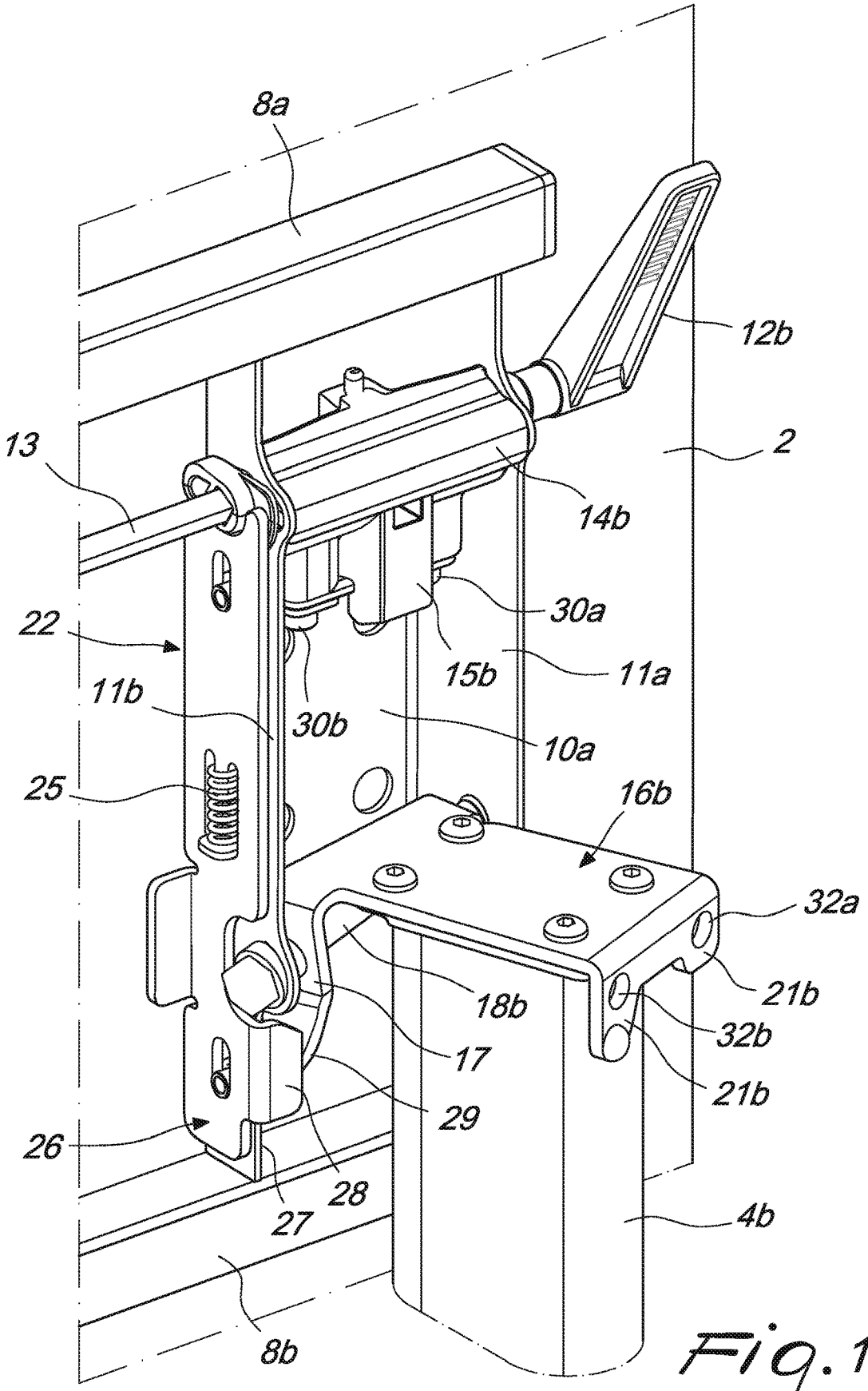
FIG. 14 is a similar view to that of FIG. 7 of the table in the condition in which the tabletop is fully tilted, and without the housing.
Figure 15:
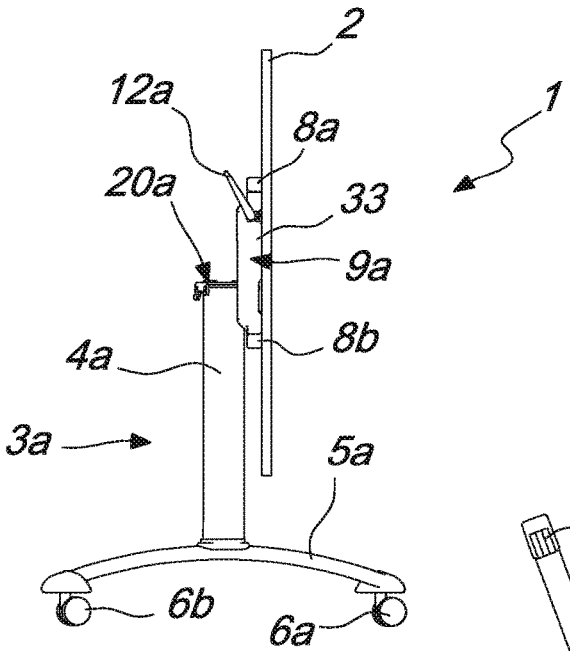
FIG. 15 is a side view of the table in the condition in which the tabletop is fully tilted.
Figure 16:
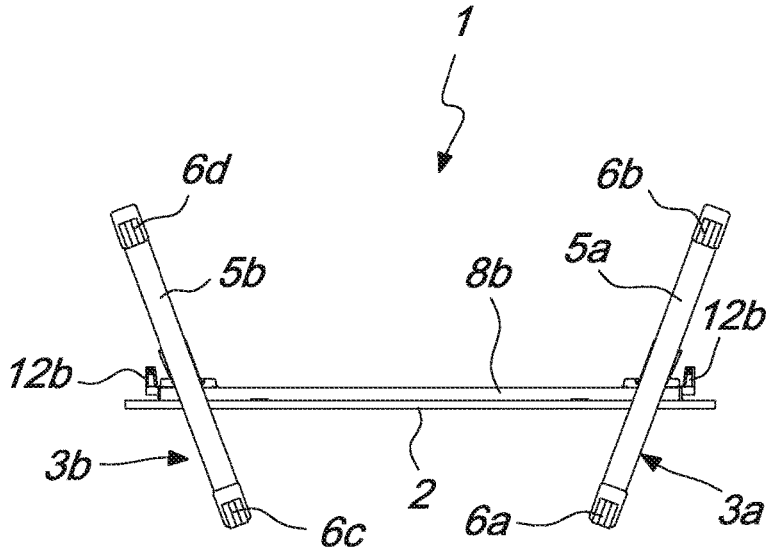
FIG. 16 is a view from below of the table in the condition in which the tabletop is fully tilted.
Figure 17:
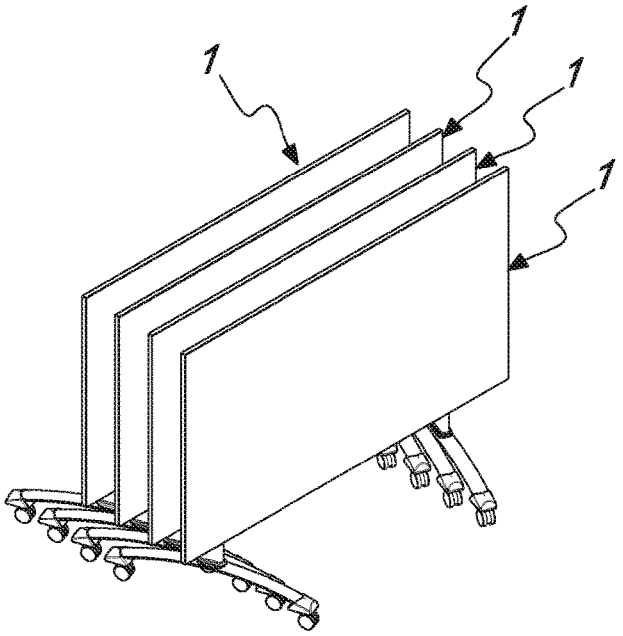
FIG. 17 is a perspective view of a series of identical tables stored together.
Figure 18:
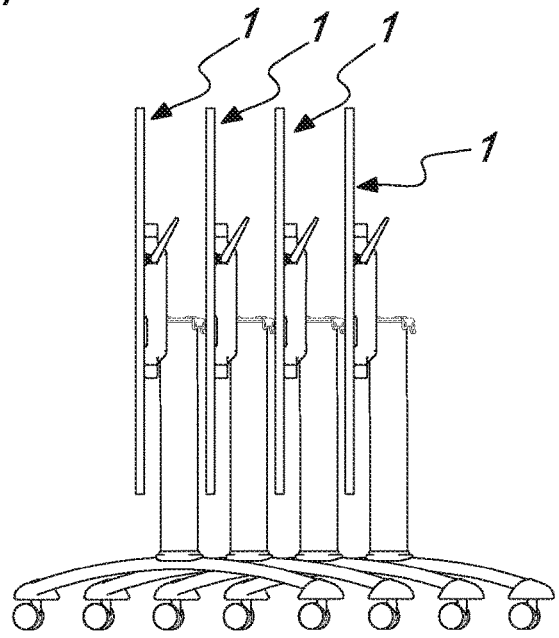
FIG. 18 is a side view of the tables in the previous figure.
Figure 19:
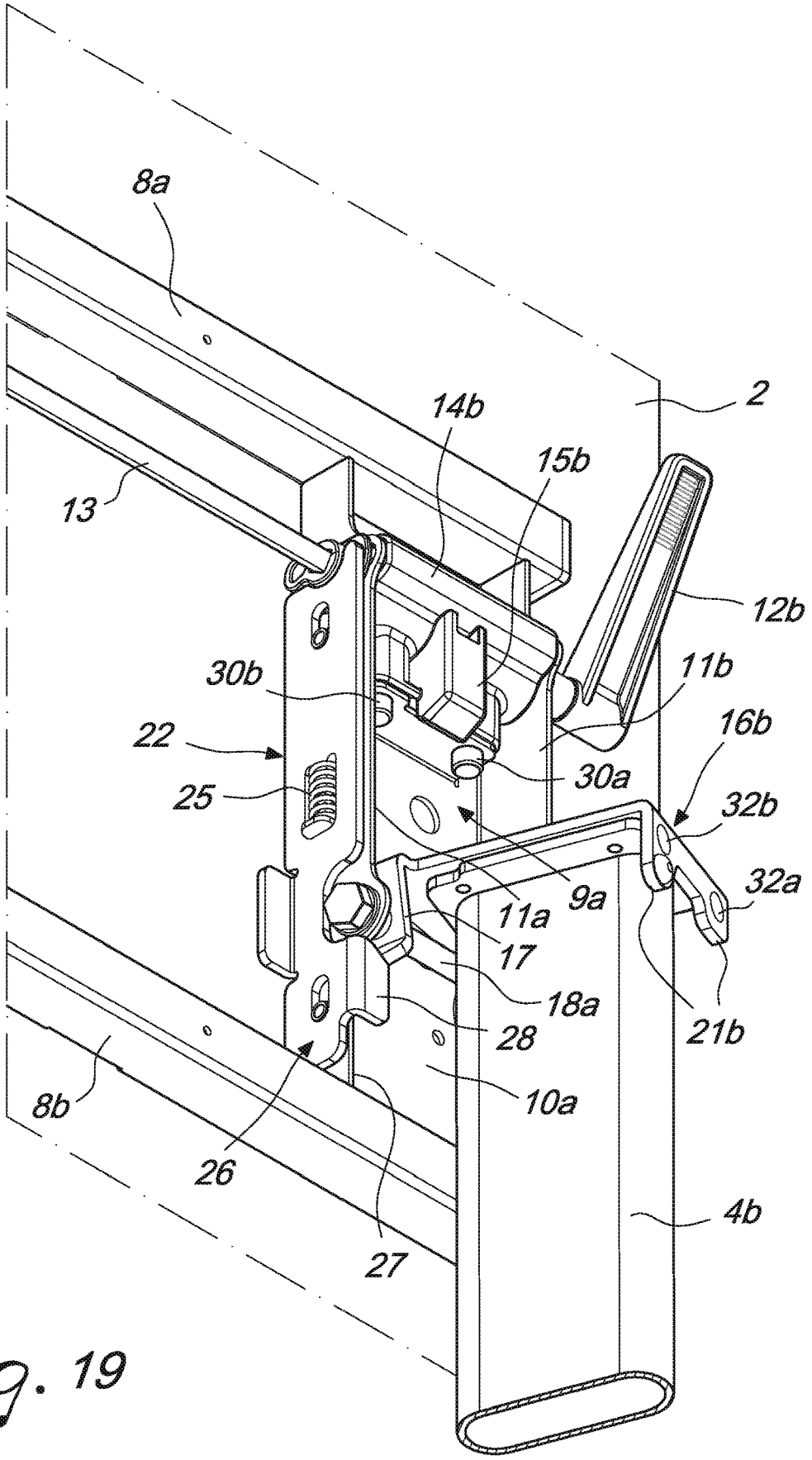
FIG. 19 is a similar view to that of FIG. 10 of the invention in the condition in which the tabletop is arranged vertically and without the housing.

The pivots 18*a*, 18*b* also pass through the first wings 11*a*, 11*b* and have an inclination of approximately ten degrees with respect to the plane of arrangement of each one of the second plates 16*a*, 16*b* and therefore of the first plates 9*a*, 9*b*, with the smaller inclination directed toward the handles 12*a*, 12*b* so that a rotation of the tabletop 2 is matched by a simultaneous rotation of the second plates 16*a*, 16*b* and therefore of the vertical posts 4*a*, 4*b* and therefore a rotation of the pair of legs 3*a*, 3*b* toward the outside of the table, as illustrated in FIGS. 11, 12 and 16.

The rotation of the second plates 16*a*, 16*b* is lockable selectively by the presence of a pair of cylinders 30*a*, 30*b* which protrude at right angles from a wall 31 that lies underneath the first teeth 15*a*, 15*b* and is arranged at right angles to the bases 10*a*, 10*b* of the first box-like plates 9*a*, 9*b*.

The wall 31 is movable axially with respect to the first box-like plates 9*a*, 9*b* following a rotation imparted to the handles 12*a*, 12*b*; the pair of cylinders 30*a*, 30*b* can then be selectively arranged within complementarily shaped seats 32*a*, 32*b* which are provided in a region underneath the free end 21*a*, 21*b* of each one of the second plates 16*a*, 16*b*.

Figure 6:
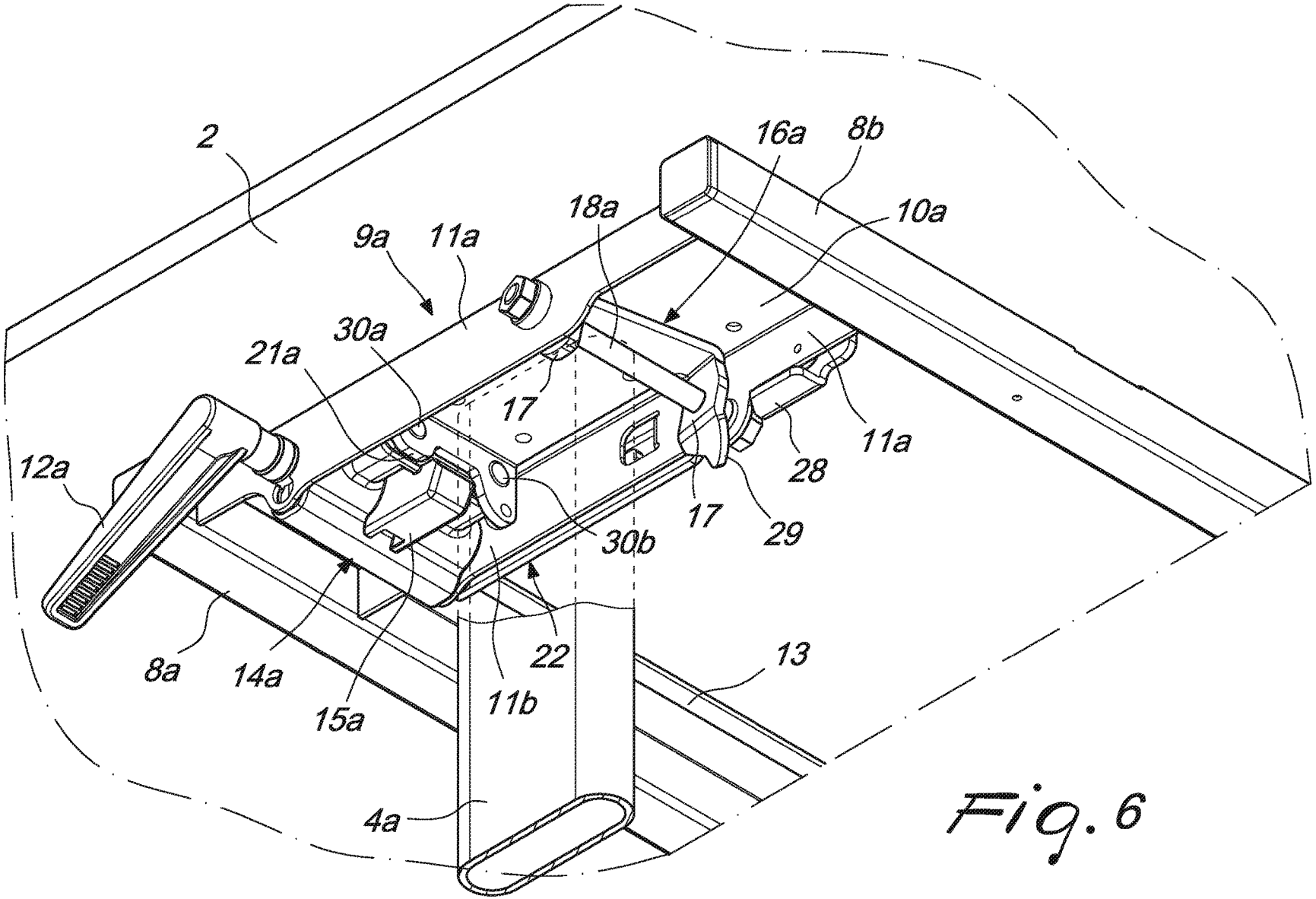
FIG. 6 is a partial view from below showing a detail of the table and without the housing.
Figure 7:
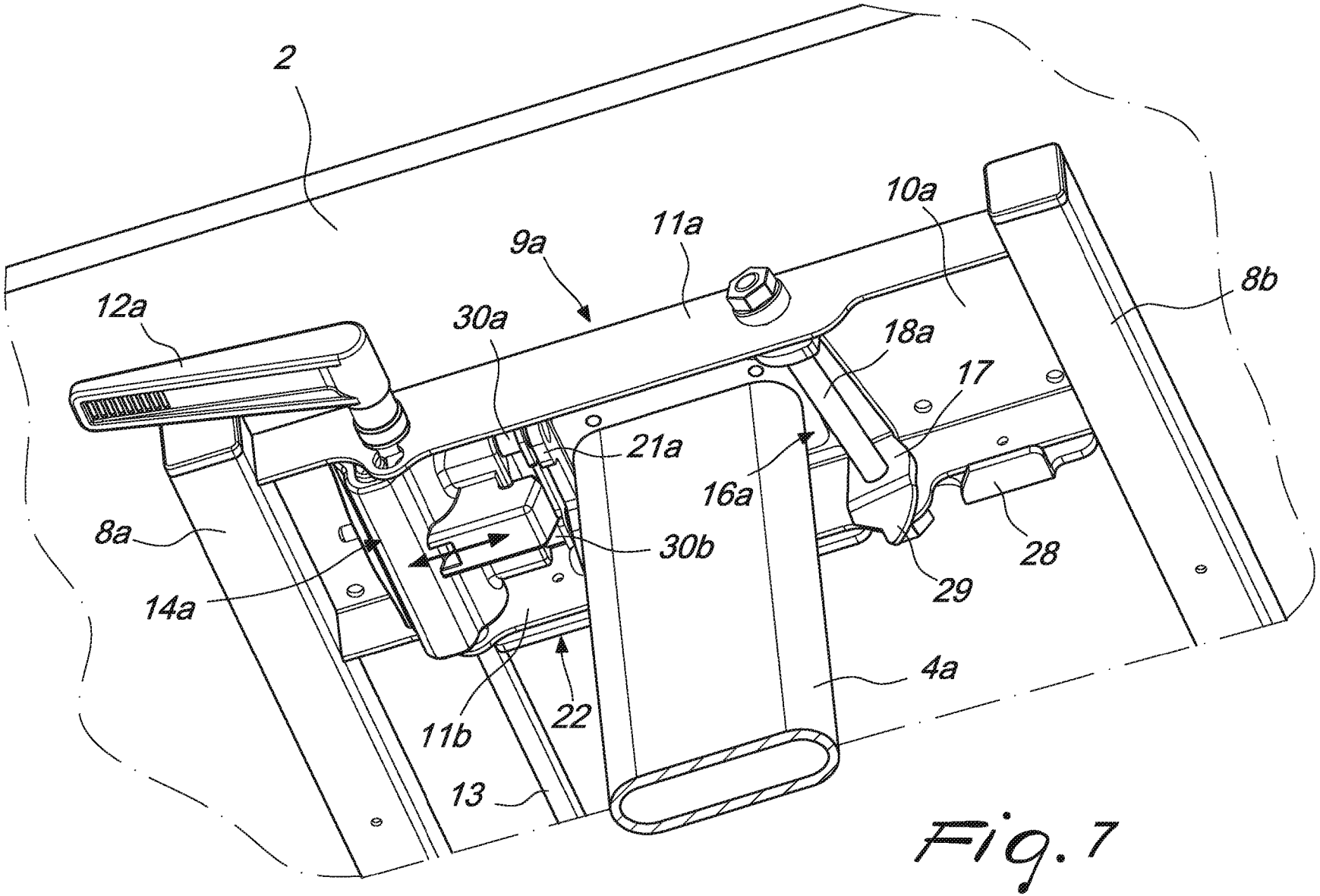
FIG. 7 shows the table of the previous figure with a lever rotated and without the housing.
Figure 8:
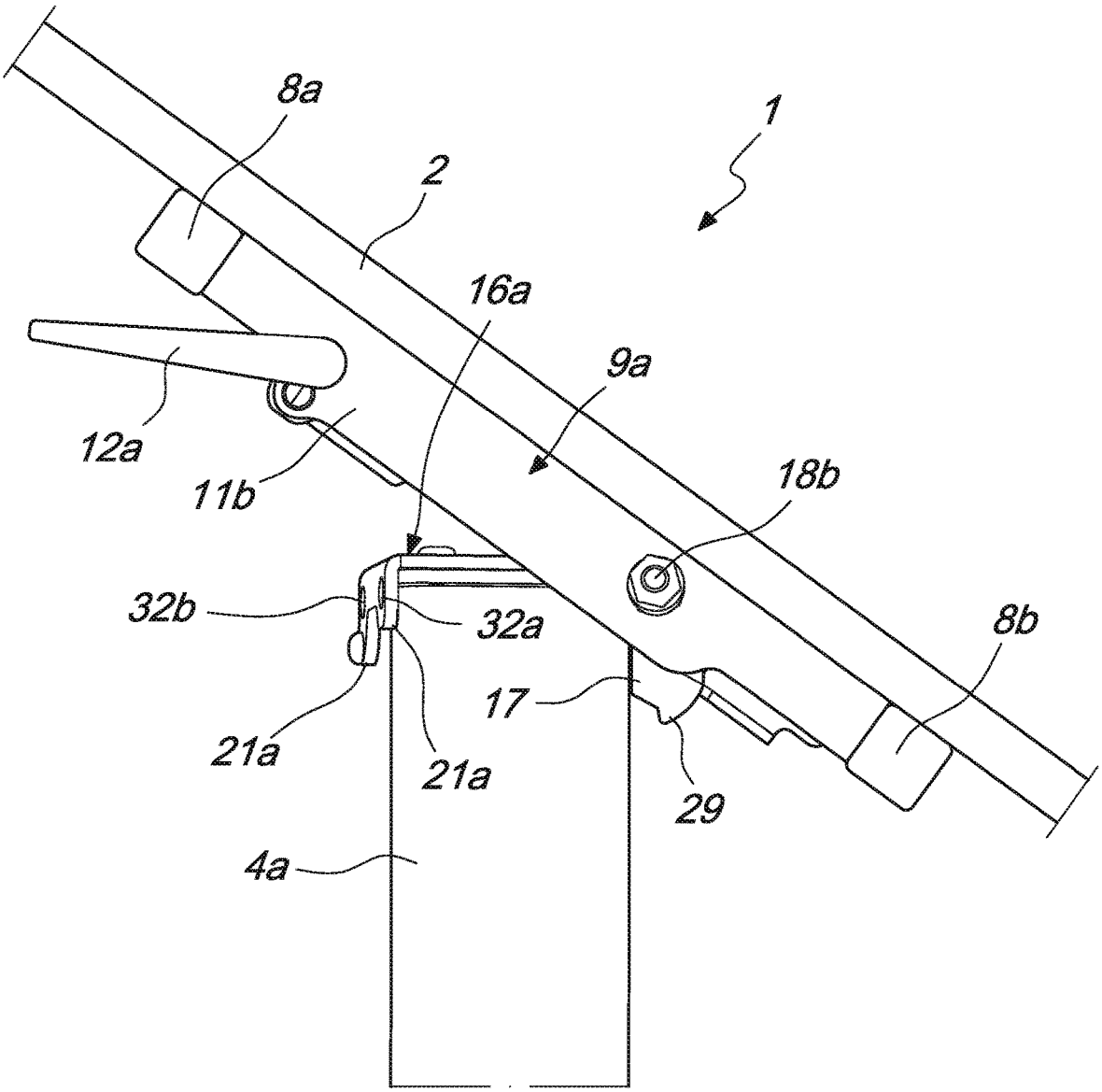
FIG. 8 is a side view of the table with the tabletop partially rotated and without the housing.
Figure 9:
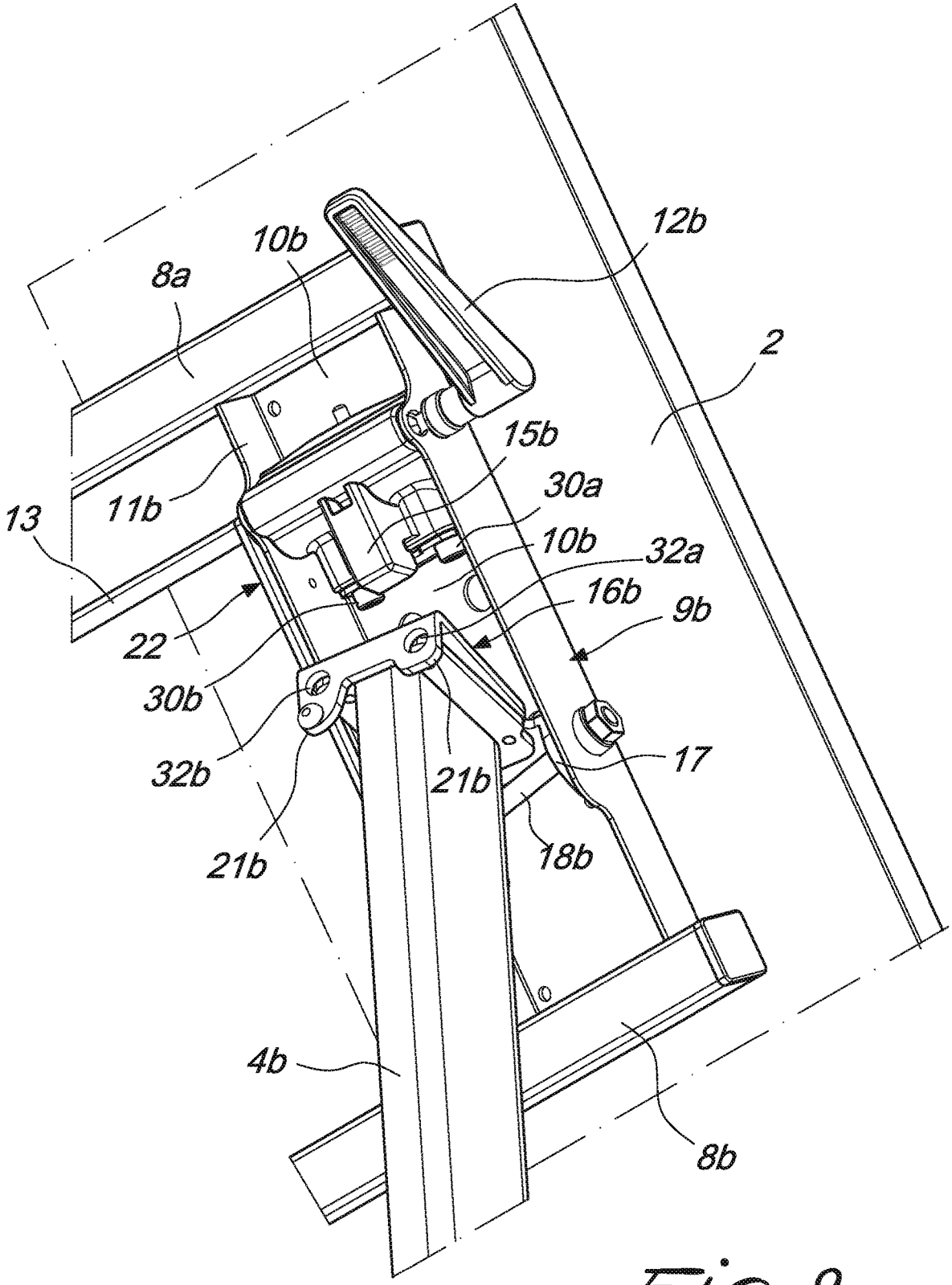
FIG. 9 is a similar view to that in FIG. 7 of the table in the condition of the previous figure without the housing.
Figure 10:
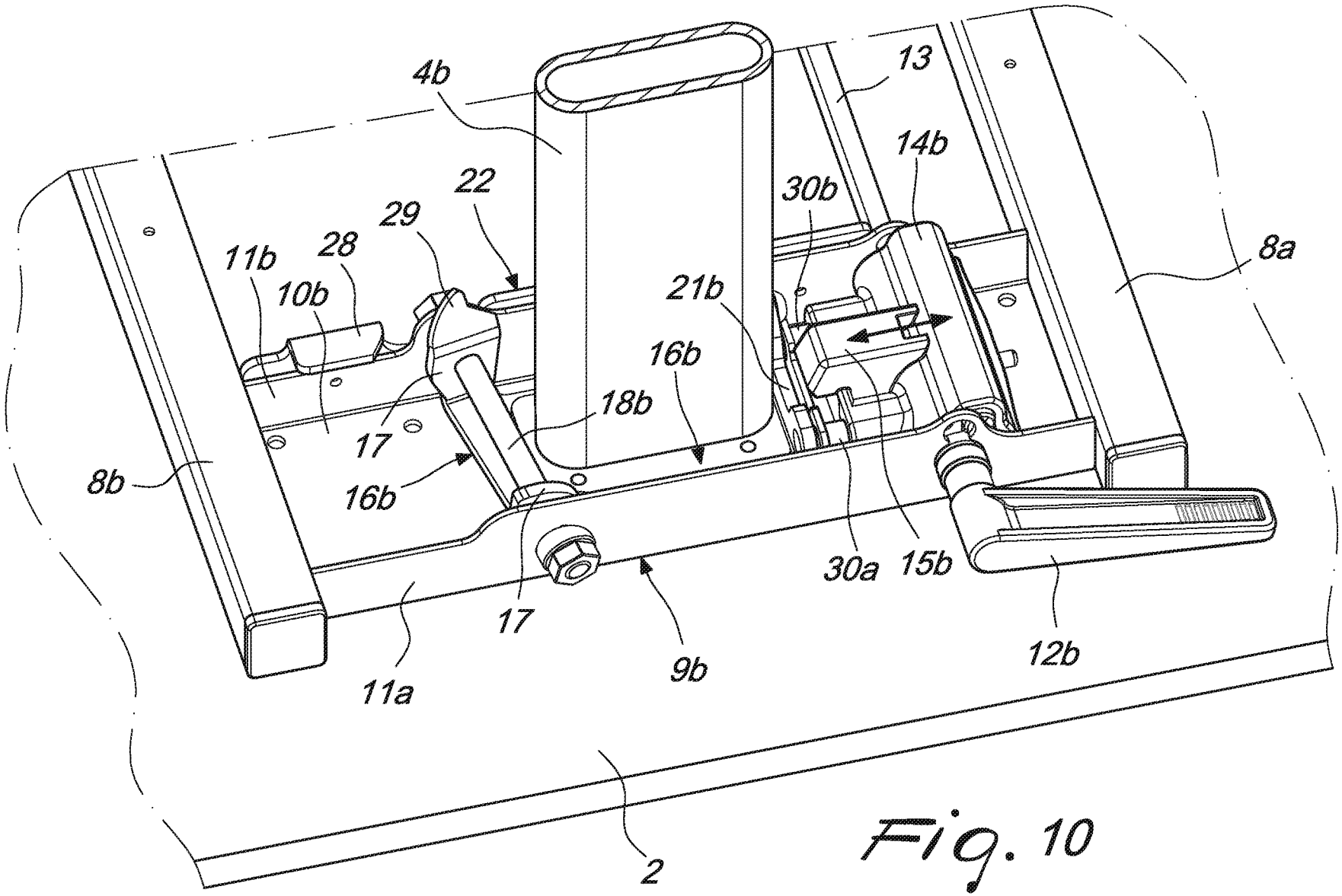
FIG. 10 is a view from below of a detail of the invention without the housing.

As illustrated for example in FIGS. 6 and 10, when the handles 12*a*, 12*b* are in the inactive position the first teeth 15*a*, 15*b* are arranged above the free ends 21*a*, 21*b* and the pair of cylinders 30*a*, 30*b* are arranged within the seats 32*a*, 32*b* so as to lock the rotation of the second plates 16*a*, 16*b*; rotating the handles 12*a*, 12*b* makes the first teeth 15*a*, 15*b* and the pair of cylinders 30*a*, 30*b* translate until they disengage from the seats 32*a*, 32*b* which are provided in the free ends 21*a*, 21*b* so as to allow the rotation of the second plates 16*a*, 16*b*.

There are also means which are adapted to prevent the accidental rotation of the tabletop 2 once it is arranged in the vertical position, such means being constituted by a third plate 22, for tilt prevention, which is laterally and slideably associated with each one of the first wings 11*a*, 11*b* which is directed in the opposite direction with respect to the handles 12*a*, 12*b*.

Each third plate 22 has a first, fork-shaped end 23 which interacts with a cam 24 which is keyed on the shaft 13 and which, upon a rotation of a handle 12*a*, 12*b*, causes the sliding of the third plate 22, in contrast with an elastically deformable element 25, toward the second end 26 which is directed in the opposite direction with respect to the first teeth 15*a*, 15*b*.

Proximate to the second end 26, a tab 28 protrudes beyond the perimetric edge 27 of one of the adjacent first wings 11*a*, 11*b* beyond the region of pertinence of the pivots 18*a*, 18*b*, a second tooth 29 interacting selectively on the tab and protruding from one of the adjacent second wings 17 in the final step in which the leg performs its rotation and the tabletop 2 is arranged so that it is rotated to the vertical.

When the tabletop 2 is in the vertical position, the second tooth 29 has ceased interacting with the tab 28 and therefore the tab is pushed, by the elastically deformable element 25, toward the shaft 13 and strikes against the adjacent second wing 17, thus blocking the tilting of the tabletop 2.

In order to release the movement of the tabletop 2, it is sufficient to rotate one of the handles 12*a*, 12*b* again so as to impart an axial movement to the third plate 22 until the second tooth 29 is moved beyond the tab 28.

Thus it has been found that the invention fully achieves the intended aim and objects, a table being obtained that has a tilting tabletop which, during tilting, entails the movement of the legs which rotate partially thus making it possible for several identical tables to be stored side by side while reducing the space that they take up overall, thus reducing as far as possible the risk of ruining the surface finish of various components.

Effectively, therefore, the invention makes it possible to achieve the simultaneous rotation of legs and tabletop, a feature that makes it possible to achieve a reduced horizontal space occupation and a better vertical stackability when being stored away.

Furthermore the table enables the operator, thanks to the handles arranged below and adjacent to the lateral ends of the tabletop, to vary the arrangement of the tabletop while always remaining outside the radius of action, thus reducing the risk of being subjected to impact or collision.

Furthermore, since the two handles are mutually connected in rotation, the user can vary the position of the tabletop using only one hand which will act on the desired one of the two handles.

The table according to the invention further makes it possible to provide a table the tabletop of which is stable both in the active position (parallel to the ground) and in the inactive position (perpendicular to the ground).

The kinetic mechanisms used make it possible to rapidly and safely achieve the tilting and the rotation of the legs, while at the same time remaining free from possible signs of wear and tear and the beginnings of shearing, and it being possible for them to be conveniently enclosed with the housing 33 in order to achieve a twofold function, aesthetic and protective, preventing the operator from inserting their fingers into the mechanisms with the risk of crushing.

Finally, the table according to the invention guarantees an optimal operation despite the complexity of movements that it makes it possible to achieve.

Naturally the materials used as well as the dimensions of the individual components of the device according to the invention may be more relevant according to specific requirements.

Thus, the shape of the legs can be the most appropriate on the basis of the specific requirements, since they can be replaced simply and rapidly without removing the tabletop or disassembling the various mechanisms, just as a drawer for magazines and other optional fixtures can be associated with the tabletop.

The characteristics indicated above as advantageous, convenient or the like, may also be missing or be substituted by equivalent characteristics.

The disclosures in Italian Patent Application No. 102019000006990 from which this application claims priority are incorporated herein by reference.

What is claimed is:

1. A table with a tilting tabletop and ground support legs, comprising:

means adapted to cause, upon a tilting of said tabletop, also a rotation of said ground support legs with respect to the ground;

two pairs of ground support legs, each one composed of a vertical post which is connected at a lower end to a longitudinal member with pairs of wheels associated in a lower region with the ends; and a tubular frame being associated below said tabletop and being composed of two crossmembers, which are shorter than said tabletop and are connected at the ends by two mutually mirror-symmetrical first box-like plates, which have a C-shaped cross-section a base of which is rectangular and is rendered integral in a lower region with said tabletop and first wings of which are directed toward the ground.

2. The table according to claim 1, wherein said means adapted to cause, upon the tilting of said tabletop to the vertical, also the rotation of said legs with respect to the ground comprises two mutually identical handles, which are rotatably associated proximate to an end of said first wings and are keyed to a shaft which is adapted to transmit a rotary motion imparted to said handles by the user, between each of said first wings there being, in axial alignment with said shaft, a block which rotates integrally with said shaft and which has a first tooth which protrudes axially therefrom substantially parallel to said bases and in an opposite direction with respect to said handles.

3. The table according to claim 2, wherein a second plate is associated at each one of said bases, is also C-shaped, is shorter than said first box-like plates, and extends substantially from a region underneath said first teeth in an opposite direction with respect to said handles, each one of said second plates having a pair of second wings which protrude at an opposite end with respect to said handles.

4. The table according to claim 3, wherein said pivots also pass through said first wings and have an inclination of approximately ten degrees with respect to the plane of arrangement of each one of said second plates and therefore of said first plates, so that a rotation of said tabletop is matched by a simultaneous rotation of said second plates and therefore of said vertical posts and therefore a rotation of said pair of legs toward the outside of said table.

5. The table according to claim 4, wherein said rotation of said second plates is lockable selectively thanks to a pair of cylinders which protrude at right angles from a wall that lies underneath said first teeth and is arranged at right angles to said bases of said first box-like plates, said wall being movable axially with respect to said first box-like plates following a rotation imparted to said handles, said pair of cylinders being arranged selectively within complementarily shaped seats which are provided in a region underneath a free end of each one of said second plates.

6. The table according to claim 5, wherein when said handles are in an inactive position said first teeth are arranged above said free ends and said pair of cylinders are arranged within said seats so as to lock the rotation of said second plates, the rotation of said handles causing an axial translation of said first teeth and of said pair of cylinders until they disengage from said seats so as to allow the rotation of said second plates.

7. The table according to claim 3, further comprising means adapted to prevent an accidental rotation of said tabletop once it is arranged in the vertical position, said means being constituted by a third plate, for tilt prevention, which is laterally and slideably, associated with each one of said first wings which is directed in an opposite direction with respect to said handles, wherein upon a rotation of one of said handles, causes a sliding of said third plate, in contrast with an elastically deformable element, toward a second end which is directed in an opposite direction with respect to said first teeth.

8. The table according to claim 7, wherein, proximate to said second end, a tab protrudes beyond a perimetric edge of one of said adjacent first wings, and a second tooth interacting selectively on said tab and protruding from one of said second wings in which the leg performs its rotation and said tabletop is arranged so that it is rotated to the vertical.

9. The table according to claim 8, wherein when said tabletop is in the vertical position, said second tooth has ceased interacting with said tab and therefore said tab is pushed by said elastically deformable element toward said shaft and strikes against said second wing, thus blocking the tilting of said tabletop, an axial movement of said third plate being obtained upon a subsequent rotation imparted to one of said handles, until said second tooth is moved beyond said tab.

* * * * *